US007481236B2

(12) United States Patent
Carter

(10) Patent No.: US 7,481,236 B2
(45) **Date of Patent: *Jan. 27, 2009**

(54) ERECTABLE SHELTER WITH COLLAPSIBLE CENTRAL ROOF SUPPORT

(76) Inventor: Mark C. Carter, 1601 Iowa Ave., Riverside, CA (US) 92507

( * ) Notice: Subject to any disclaimer, the term of this patent is extended or adjusted under 35 U.S.C. 154(b) by 0 days.

This patent is subject to a terminal disclaimer.

(21) Appl. No.: 11/768,787

(22) Filed: Jun. 26, 2007

(65) Prior Publication Data

US 2007/0283993 A1 Dec. 13, 2007

Related U.S. Application Data

(63) Continuation of application No. 11/263,303, filed on Oct. 31, 2005, now Pat. No. 7,240,687, which is a continuation of application No. 10/802,221, filed on Mar. 16, 2004, now Pat. No. 6,981,510, which is a continuation of application No. 10/345,903, filed on Jan. 16, 2003, now Pat. No. 6,712,083, which is a continuation of application No. 10/086,077, filed on Feb. 28, 2002, now Pat. No. 6,520,196, which is a continuation of application No. 09/844,836, filed on Apr. 27, 2001, now Pat. No. 6,363,956, which is a continuation of application No. 09/550,404, filed on Apr. 14, 2000, now Pat. No. 6,230,729, which is a continuation of application No. 09/130,774, filed on Aug. 7, 1998, now Pat. No. 6,070,604.

(51) Int. Cl.
*E04H 15/46* (2006.01)

(52) U.S. Cl. ..... 135/140; 135/135; 135/142; 135/146; 135/114; 403/109.1

(58) Field of Classification Search ..... 135/130–131, 135/135, 139–146, 158–159, 114, 905; 403/109.1, 403/109.3, 109.8, 161, 326; 248/188.5
See application file for complete search history.

(56) References Cited

U.S. PATENT DOCUMENTS

| | | | |
|---|---|---|---|
| 1,712,836 | A | 5/1929 | Mills |
| 1,853,367 | A | 4/1932 | Mace |
| 2,989,329 | A | 6/1961 | Noah |
| 3,103,375 | A | 9/1963 | McMullin |
| 3,712,652 | A | 1/1973 | Uikema |
| 4,063,830 | A | 12/1977 | Ban |
| 4,385,849 | A | 5/1983 | Crain |
| 4,407,317 | A | 10/1983 | Crandall |

(Continued)

FOREIGN PATENT DOCUMENTS

| | | |
|---|---|---|
| AU | 25649/88 B | 6/1992 |

(Continued)

*Primary Examiner*—Winnie Yip
(74) *Attorney, Agent, or Firm*—Fulwider Patton LLP

(57) ABSTRACT

A telescoping pole assembly for an erectable, collapsible shelter, includes first and second hollow telescoping sections slidably connected together, the first telescoping section being slidably disposed within the second telescoping section, and a spring loaded detent pin mounted to the second telescoping section. A weighted internal stop member is slidably disposed within the first telescoping section for movement between a first position and a second position. The internal stop member blocks the spring loaded detent pin in the first position, and the internal stop member does not block the spring loaded detent pin in the second position.

10 Claims, 4 Drawing Sheets

U.S. PATENT DOCUMENTS

| | | | |
|---|---|---|---|
| 4,601,301 | A | 7/1986 | Hermanson |
| 4,607,656 | A | 8/1986 | Carter |
| 4,641,676 | A | 2/1987 | Lynch |
| 4,779,635 | A | 10/1988 | Lynch |
| 4,941,500 | A | 7/1990 | Emard |
| 4,947,884 | A | 8/1990 | Lynch |
| 5,035,253 | A | 7/1991 | Bortles |
| 5,244,001 | A | 9/1993 | Lynch |
| 5,275,188 | A | 1/1994 | Tsai |
| 5,485,863 | A | 1/1996 | Carter |
| 5,511,572 | A | 4/1996 | Carter |
| 5,634,483 | A | 6/1997 | Gwin |
| 5,701,923 | A | 12/1997 | Losi, Jr. et al. |
| 5,797,797 | A | 8/1998 | Parsons |

FOREIGN PATENT DOCUMENTS

| | | | |
|---|---|---|---|
| WO | 92/12313 | A1 | 9/1992 |
| WO | 96/41928 | A1 | 12/1996 |

FIG. 3
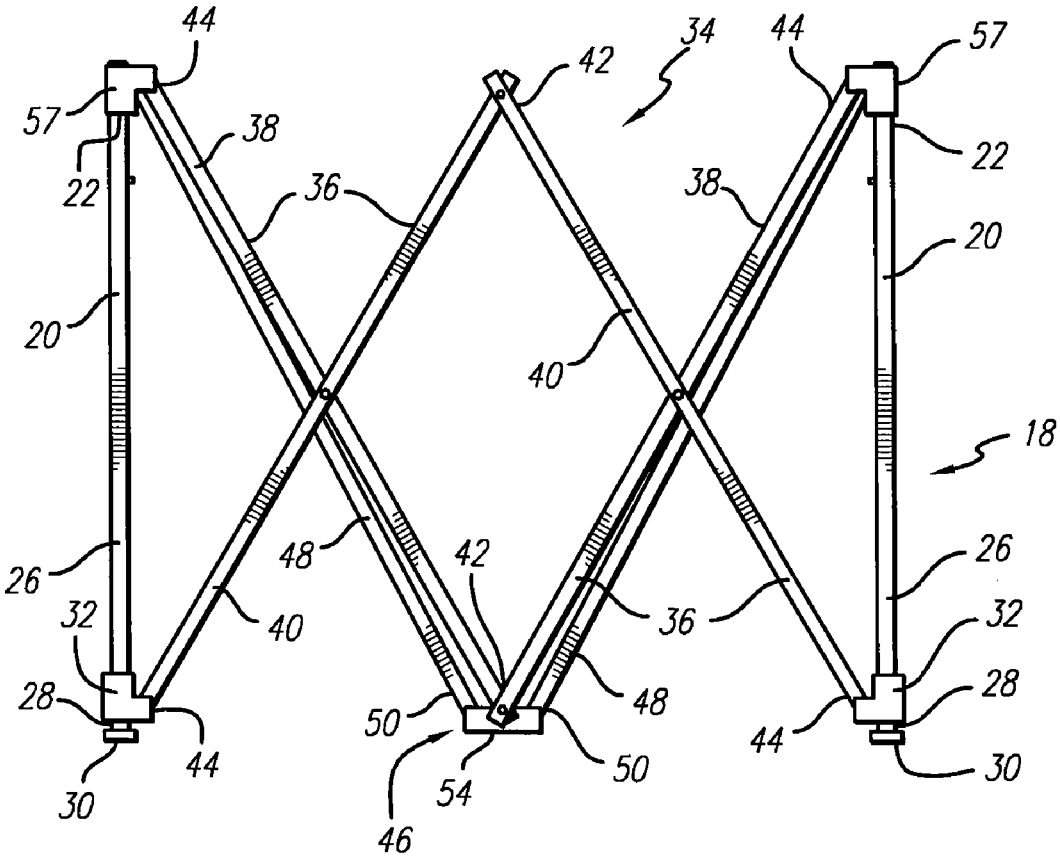
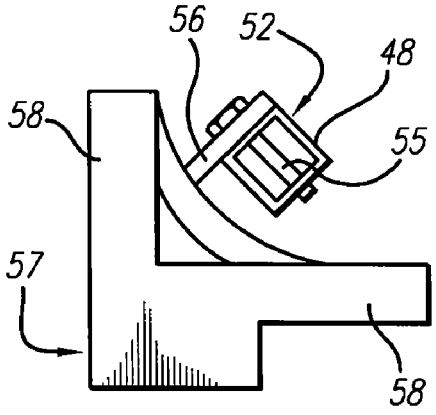
FIG. 4
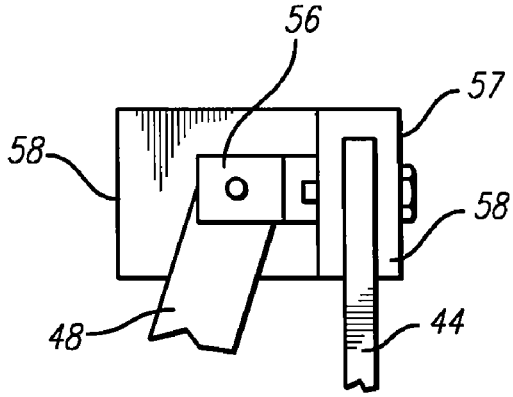
FIG. 5

FIG. 9
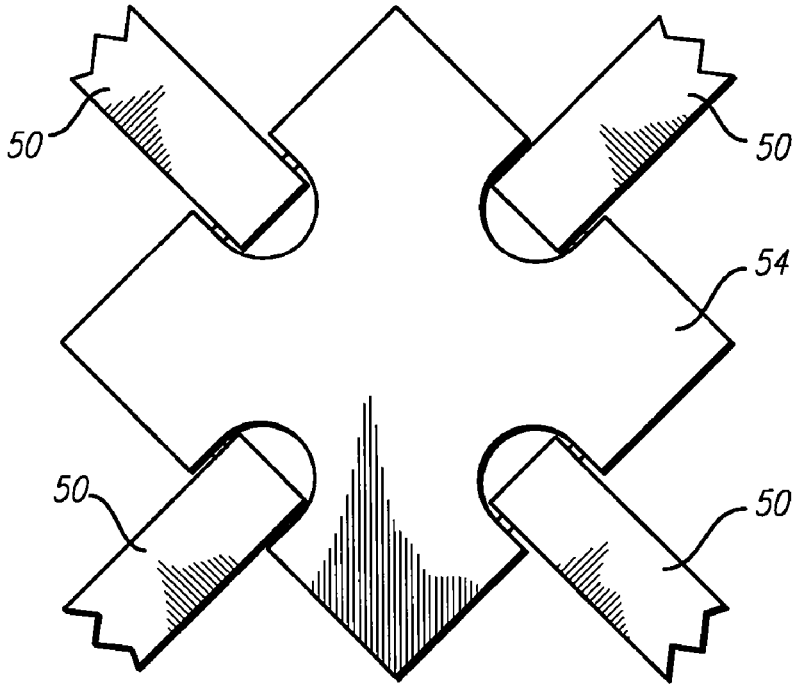
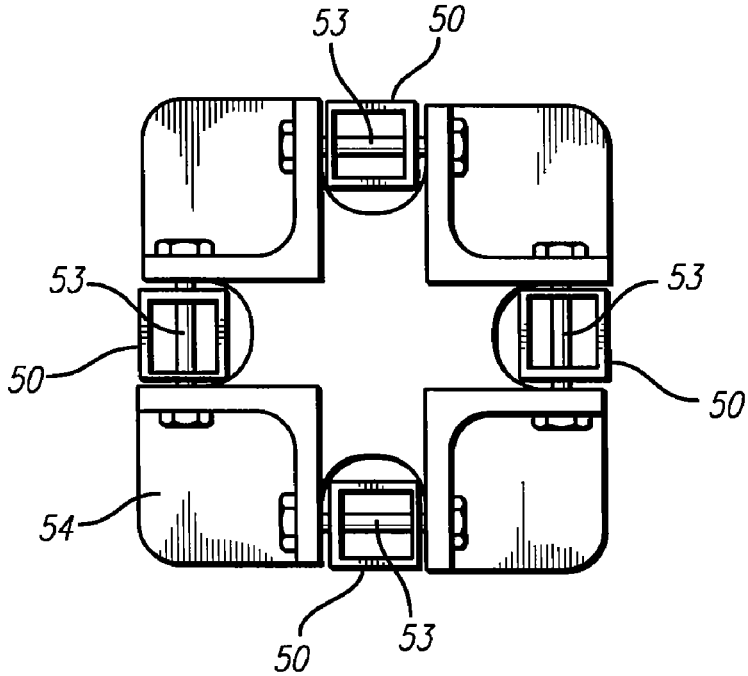
FIG. 10

ERECTABLE SHELTER WITH COLLAPSIBLE CENTRAL ROOF SUPPORT

CROSS-REFERENCE TO RELATED APPLICATION

This is a Continuation of application Ser. No. 11/263,303, filed 31 Oct. 2005, now U.S. Pat. No. 7,240,687, which is a Continuation of application Ser. No. 10/802,221, filed 16 Mar. 2004, now U.S. Pat. No. 6,981,510, issued 3 Jan. 2006; which is a Continuation of application Ser. No. 10/345,903, filed 16 Jan. 2003, now U.S. Pat. No. 6,712,083, issued 30 Mar. 2004; which is a Continuation of application Ser. No. 10/086,077, filed 28 Feb. 2002, now U.S. Pat. No. 6,520,196, issued 18 Feb. 2003; which is a Continuation of application Ser. No. 09/844,836, filed 27 Apr. 2001, now U.S. Pat. No. 6,363,956, issued 2 Apr. 2002; which is a Continuation of application Ser. No. 09/550,404, filed 14 Apr. 2000, now U.S. Pat. No. 6,230,729, issued 15 May 2001; which is a Continuation of application No. 09/130,774, filed 7 Aug. 1998, now U.S. Pat. No. 6,070,604, issued 6 Jun. 2000.

BACKGROUND OF THE INVENTION

1. Field of the Invention

This invention relates generally to folding, collapsible structures, and more particularly relates to a collapsible, field shelter structure having an elevated canopy.

2. Description of Related Art

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One such quickly erectable, collapsible shelter having a framework of X-shaped linkages, telescoping legs, and a canopy covering the framework is described in my U.S. Pat. No. 4,607,656. The legs of that shelter are capable of telescoping to about twice their stowed length, and the framework of X-shaped truss pairs is capable of horizontal extension between the legs to support a canopy. The framework can be constructed of lightweight material, and the telescoping legs can be extended to raise the framework of the shelter. However, the height of the canopy is limited to the extended length of the legs, and the canopy is essentially flat, allowing for collection of precipitation and debris on top of the canopy, which can promote leaks and tears in the canopy. In addition, the size and stability of the shelter is generally limited by the strength of the framework.

It would be desirable to provide an improved collapsible shelter with a support framework for the canopy that rises above the supporting legs, to provide for more headroom within the structure, and to allow for a reduction in the size and weight of the legs and framework required to achieve an adequate height of the canopy, and to shed precipitation and debris from the top of the shelter. The present invention meets these and other needs.

SUMMARY OF THE INVENTION

Briefly, and in general terms, the present invention provides for a collapsible shelter with an improved canopy peak support assembly that raises the shelter canopy above the top of the legs to provide increased headroom, strength and stability.

The invention accordingly provides for an erectable, collapsible shelter having a collapsed configuration and an extended configuration. The shelter comprises a canopy having at least three sides and three corners, a leg assembly having at least three legs supporting the canopy, the legs having an upper end and a lower end, and a perimeter truss linkage assembly having a plurality of perimeter truss pairs of link members connected to the leg assembly. The legs preferably have telescoping upper and lower sections with lower section for engagement with ground, and a slider member slidably mounted to the upper section of each of the legs.

Each of the perimeter truss pairs preferably includes first and second link members pivotally connected together in a scissors configuration, the first and second link members having inner and outer ends, the outer end of each the first link member connected to the upper end of one of the legs, and the outer end of each second link slidably connected to the leg. A canopy peak support assembly is provided that is movable between a raised position and a lowered position, with the canopy peak support assembly supporting the canopy above the top of the leg assembly in the raised position.

In a presently preferred embodiment, the canopy peak support assembly comprises a plurality of telescoping pole members having first and second ends, the first ends of the telescoping pole members being pivotally connected together, and the second ends of the telescoping pole members being pivotally connected to the leg assembly such that the telescoping pole members can moved between a downwardly directed position and an upwardly directed position supporting the canopy. The first ends of the telescoping pole members are typically pivotally connected together by a bracket member adapted for supporting the canopy.

In a preferred aspect of the invention, the telescoping pole members comprise hollow first and second telescoping sections, the first telescoping section slidably disposed within the second telescoping section and having a distal end for supporting the canopy and a proximal end, the second telescoping section having a spring loaded detent pin and an aperture for receiving the spring loaded detent pin, the first telescoping section having a corresponding medially located aperture located medially of the proximal end for receiving the spring loaded detent pin, whereby when the apertures of the first and second telescoping sections are aligned, the first and second telescoping sections are locked together by the detent pin.

In another presently preferred aspect of the invention, the first telescoping section has a weighted internal stop member slidably disposed within the first telescoping section for movement between a first position blocking the detent pin when the first telescoping section is below the second telescoping section and a second position not blocking the detent pin when the first telescoping section is above the second telescoping section. The weighted internal stop member is preferably retained in the first telescoping section between first and second stop members disposed within the first telescoping section. In another presently preferred aspect, the first telescoping section has a second, proximal aperture for receiving the spring loaded detent pin proximal to the medially located aperture, and a ramped channel for receiving the detent pin, the ramped channel extending from and becoming shallower distally from the second aperture, such that when the detent pin is received in the second aperture, the detent pin locks the first and second telescoping sections from being disengaged, and the detent pin can slide distally from the second aperture along the channel.

These and other aspects and advantages of the invention will become apparent from the following detailed description and the accompanying drawings, which illustrate by way of example the features of the invention.

BRIEF DESCRIPTION OF THE DRAWINGS

FIG. 3 is a front view of the framework of the erectable shelter of FIG. 1 not showing the canopy for simplicity, in a generally collapsed configuration;

FIG. 4 is an enlarged top plan view of a mounting bracket of a leg, for a telescoping pole section and outer ends of the first link members of the perimeter truss pairs of link members;

FIG. 5 is an elevational view of the mounting bracket of FIG. 4;

FIG. 9 is an expanded top plan view of the central bracket member of the canopy peak support assemble of FIG. 7; and FIG. 10 is a bottom view of the central bracket member of the canopy peak support assemble of FIG. 7.

DETAILED DESCRIPTION OF THE PREFERRED EMBODIMENTS

The size and available headroom of previous collapsible shelters have been generally limited by the extended length of the legs of the structure. Such shelters typically provided essentially flat roof structures, allowing for collection of precipitation in pockets or puddles on top of the shelter.

Figure 1:
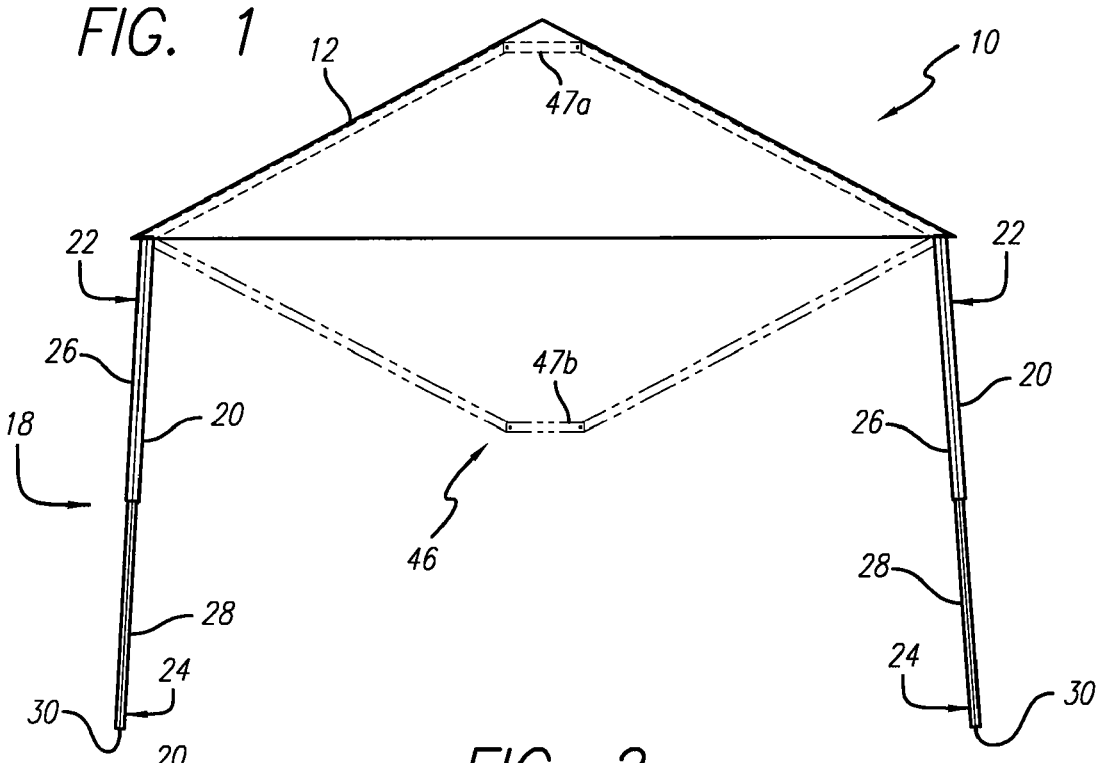
FIG. 1 is a front elevational view of the erectable shelter of the invention, in an extended configuration.
Figure 2:
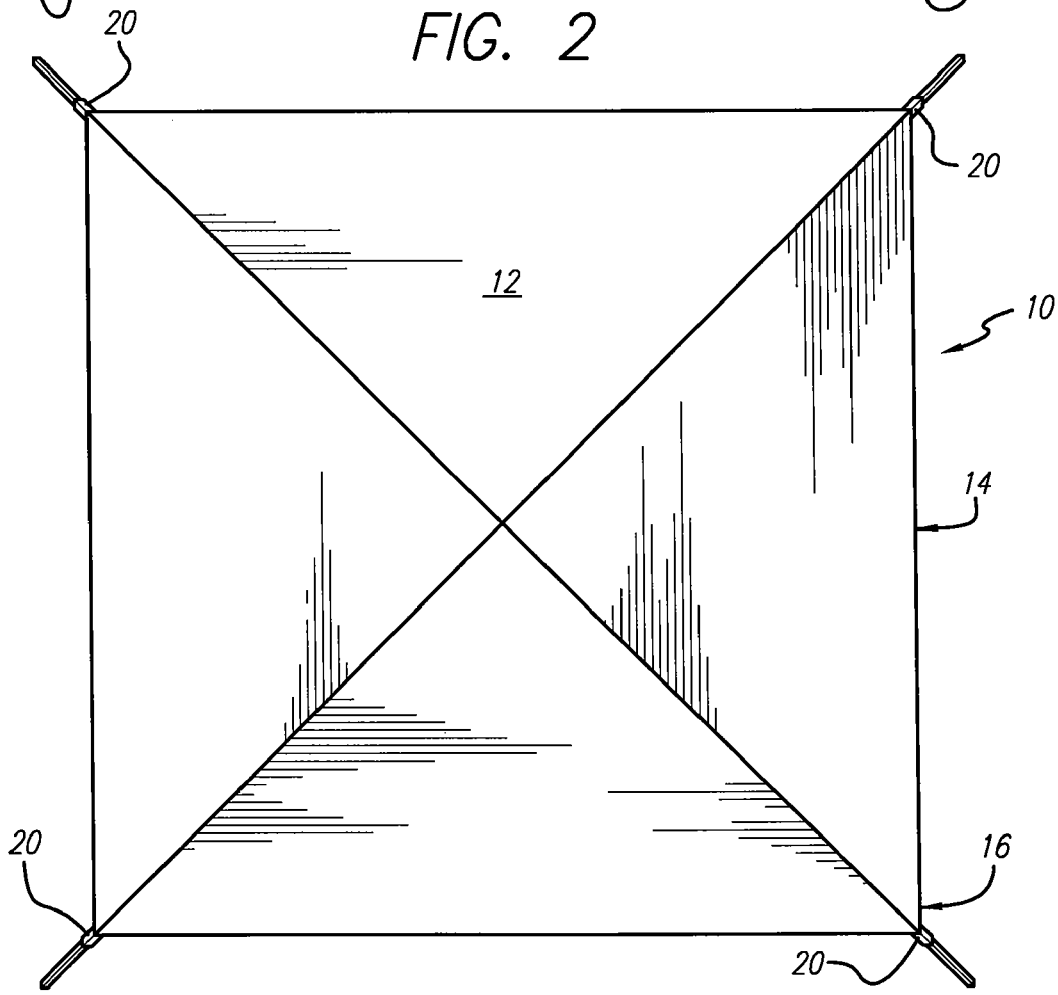
FIG. 2 is a top plan view of the erectable shelter of FIG. 1.
Figure 6:
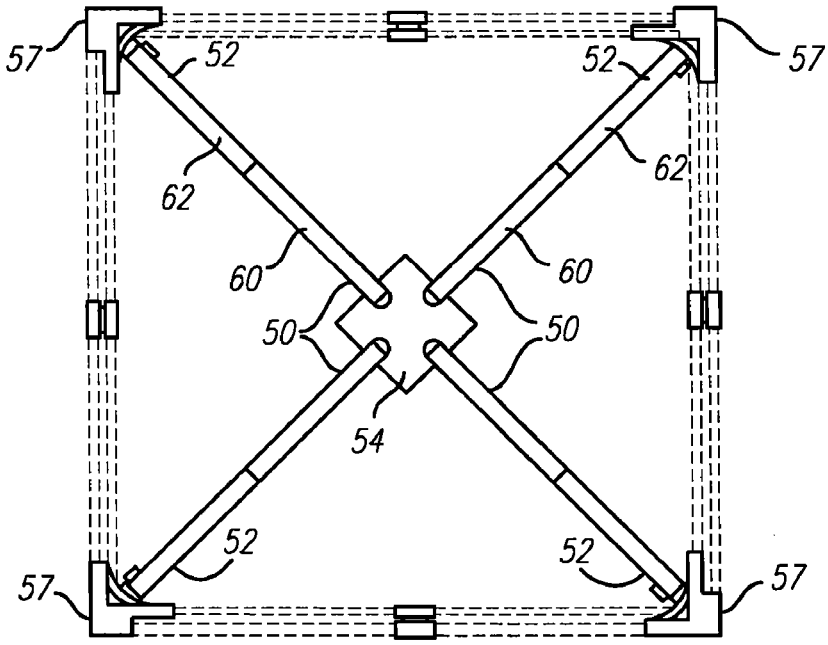
FIG. 6 is a top plan view of the framework of FIG. 3, showing the canopy peak support assembly of the erectable shelter of the invention.
Figure 7:
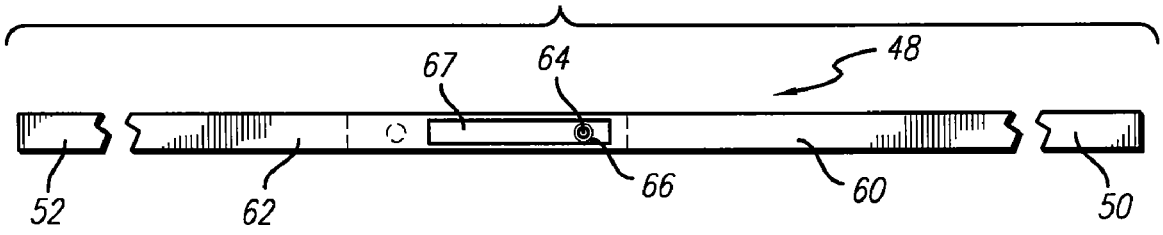
FIG. 7 is a schematic diagram of a telescoping pole member of the canopy peak support assembly of FIG. 6.
Figure 8:
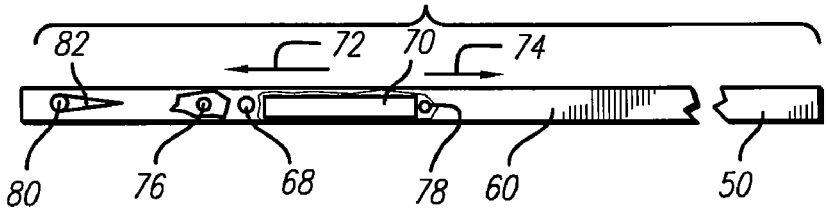
FIG. 8 is a schematic diagram of the first telescoping section of the telescoping pole member of FIG. 7.

As is illustrated in the drawings, the invention is embodied in an erectable, collapsible shelter 10 having an extended configuration as shown in FIGS. 1 and 2, and a collapsed configuration as illustrated in FIG. 3. The shelter has a canopy 12, and generally has at least three sides 14 and three corners 16, with a leg assembly 18 having at least three legs 20 supporting the canopy. The legs have an upper end 22 and a lower end 24, and preferably comprise a hollow upper section 26 and a telescoping lower section 28, with the lower section slidably disposed within the upper section, with the lower section having a foot section 30 for engagement with the ground. A slider member 32 is slidably mounted to each of the legs, and is preferably mounted to the upper sections of the legs.

Referring to FIG. 3, a perimeter truss linkage assembly 34 having a plurality of perimeter truss pairs of link members 36 is connected to the leg assembly, with each of the perimeter truss pairs including first link members 38 and second link members 40 that are pivotally connected together in a scissors configuration. The first and second link members have inner ends 42 and outer ends 44, with the outer end of each the first link member being connected to the upper end of one the leg, and the outer end of each second link being pivotally connected to a slider member so as to be slidably connected to the leg.

As is illustrated in FIGS. 3 and 6 to 10, in a presently preferred embodiment, the shelter of the invention also comprises a canopy peak support assembly 46 movable between a raised position and a lowered position, and supporting the canopy above the top of the leg assembly in the raised position. The canopy peak support assembly preferably includes a plurality of telescoping pole members 48 each having a first or distal end 50 for supporting the canopy and a second or proximal end 52, with the first ends of the telescoping pole members being pivotally connected together, and the second ends of the telescoping pole members being pivotally connected to the leg assembly such that the telescoping pole members can moved between a downwardly directed position and an upwardly directed position supporting the canopy. As is illustrated in FIGS. 9 and 10, in a presently preferred aspect of the invention, the first or distal ends of the telescoping pole members are pivotally connected together by bolts 53 to a central bracket member 54 adapted for supporting the canopy.

As is shown in FIGS. 3 to 6, the proximal ends of the telescoping pole members are pivotally connected to the tops of the legs, preferably journalled by a bolt 55 to a tab 56 typically welded to a leg bracket 57 secured as by bolts or screws to the top ends of the legs. The bracket 57 includes two sockets 58 extending at approximately right angles from each other from the body of the bracket, which is preferably made of a tough, durable plastic. The outer ends of the first link members are received in the sockets of the bracket 57 for connecting the perimeter truss pairs of link members to the legs, as is illustrated in FIG. 5.

The telescoping pole sections advantageously comprise a hollow first telescoping section 60 and a second telescoping section 62, with the first telescoping section typically being slidably disposed within the second telescoping section. The telescoping pole sections each have a spring loaded detent pin 64 and an aperture 66 for receiving the spring loaded detent pin. The spring loaded detent pin currently preferably comprises a leaf spring 67 welded to the second telescoping section and bearing the detent pin on the inner side of the free end of the leaf spring. The first telescoping section has a corresponding medially located aperture 68 located medially of the proximal end for receiving the spring loaded detent pin, whereby when the apertures of the first and second telescoping sections are aligned, the first and second telescoping sections are locked together by the detent pin.

In another presently preferred aspect of the invention, the first telescoping section has a weighted internal stop member 70 that is slidably disposed within the first telescoping section for sliding movement by gravity, between a first position 72 blocking the detent pin, i.e. when the first telescoping section is above the second telescoping section, and a second position 74 not blocking the detent pin, i.e. when the first telescoping section is below the second telescoping section. The weighted internal stop member is retained in the first telescoping section between a first stop member 76 and a second stop member 78 disposed on either side of the internal stop member within the first telescoping section. In another presently preferred aspect of the invention, the surface of the first telescoping section also defines a second aperture 80 located proximally of the medially located aperture for receiving the spring loaded detent pin, and a ramped channel 82 for receiving the detent pin. The ramped channel extends from and becomes shallower distally from the second, proximal aperture, such that when the detent pin is received in the second, proximal aperture, the detent pin locks the first and second telescoping sections from being disengaged, and the detent pin can slide distally from the second, proximal aperture along the channel.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A canopy peak support assembly for connection to a leg assembly of a collapsible shelter, the canopy peak support assembly being movable between a raised position and a lowered position, the canopy peak support assembly comprising:

a plurality of telescoping pole members having first and second ends, said first ends of said telescoping pole members being pivotally connected together at said first ends, each of said telescoping pole members including a first telescoping section and a second telescoping section slidably connected together, said second telescoping section having a spring loaded detent pin and said first telescoping section having an aperture for receiving said spring loaded detent pin, and said first telescoping section having a weighted internal stop member slidably disposed within said first telescoping section moveable between a first position blocking said detent pin and a second position not blocking said detent pin.

2. The canopy peak support assembly of claim 1, wherein said first ends of said telescoping pole members are pivotally connected together by a bracket member.

3. The canopy peak support assembly of claim 1, wherein said weighted internal stop member is retained between first and second stop members disposed within said first telescoping section.

4. A canopy peak support assembly for connection to a leg assembly of a collapsible shelter, the canopy peak support assembly being movable between a raised position and a lowered position, the canopy peak support assembly comprising:

a plurality of telescoping pole members having first and second ends, the first ends of the telescoping pole members being pivotally connected together, and the second ends of the telescoping pole members being pivotally connected to the leg assembly, each of the telescoping pole members including first and second hollow telescoping sections slidably connected together, the second telescoping section including a spring loaded detent pin, and the first telescoping section including an aperture for receiving the spring loaded detent pin, said first telescoping section including a weighted internal stop member slidably disposed within the first telescoping section moveable between a first position and a second position, the weighted internal stop member blocking the spring loaded detent pin in the first position, and the weighted internal stop member not blocking the spring loaded detent pin in the second position.

5. The canopy peak support assembly of claim 4, wherein the first telescoping section comprises a surface defining a second aperture for receiving the spring loaded detent pin proximal to the medially located aperture, the surface of the first telescoping section defining a ramped channel adjacent to said second aperture for receiving the detent pin, said ramped channel tapering to become shallower distally from the second aperture, such that when the detent pin is received in the second aperture, the detent pin locks the first and second telescoping sections from being disengaged, and the detent pin can slide distally from the second aperture along the ramped channel.

6. The canopy peak support assembly of claim 5, wherein the telescoping pole members are pivotally connected together by a bracket member.

7. The canopy peak support assembly of claim 4, wherein the weighted internal stop member is retained between first and second stop members disposed within the first telescoping section.

8. A canopy peak support assembly for connection to a leg assembly of a collapsible shelter, the canopy peak support assembly being movable between a raised position and a lowered position, the canopy peak support assembly comprising:

a plurality of telescoping pole members each including:

first and second hollow telescoping sections slidably connected together, said first and second telescoping sections having proximal and distal ends, and said first telescoping section being slidably disposed within said second telescoping section;

a spring loaded detent pin mounted to said second telescoping section;

an aperture defined in the second telescoping section for receiving the spring loaded detent pin;

a medial aperture defined in said first telescoping section medially of said proximal end of said first telescoping section and corresponding to said aperture defined in the second telescoping section, for receiving said spring loaded detent pin, whereby when said apertures of said first and second telescoping sections are aligned, said first and second telescoping sections are locked together by said detent pin; and stop means for blocking the spring loaded detent pin, said stop means having first and second positions, said stop means blocking the spring loaded detent pin in the first position, and not blocking the spring loaded detent pin in the second position.

9. The canopy peak support assembly of claim 8, wherein the first telescoping section comprises a second aperture for receiving the spring loaded detent pin located proximal to the medial aperture.

10. The canopy peak support assembly of claim 8, wherein the surface of the first telescoping section defines a ramped channel adjacent to the second aperture for receiving the detent pin, said ramped channel tapering and becoming shallower distally from the second aperture, such that when the detent pin is received in the second aperture, the detent pin locks the first and second telescoping sections from being disengaged, and the detent pin can slide from the second aperture along the channel.

* * * * *